US005297374A

United States Patent [19]

Himes

[11] Patent Number: 5,297,374

[45] Date of Patent: Mar. 29, 1994

[54] PREFABRICATED BUILDING STRUCTURE HAVING A COLLAPSIBLE HIP ROOF AND METHOD OF ERECTING THE ROOF

[75] Inventor: J. Todd Himes, Walkersville, Md.

[73] Assignee: North American Housing Corp., Point of Rocks, Md.

[21] Appl. No.: 952,093

[22] Filed: Sep. 28, 1992

[51] Int. Cl.[5] ..... E04B 7/08; E04B 1/32

[52] U.S. Cl. ..... 52/641; 52/94; 52/90.1

[58] Field of Search ..... 52/71, 79.1, 79.5, 90.1, 52/94, 641, 644, 645, 92.1

[56] References Cited

U.S. PATENT DOCUMENTS

| | | | |
|---|---|---|---|
| Re. 31,234 | 5/1983 | Jureit et al. . | |
| 2,836,077 | 10/1945 | Van Norman . | |
| 3,063,103 | 11/1962 | Rylander | 52/94 |
| 3,404,496 | 10/1968 | Ballard . | |
| 3,485,346 | 12/1969 | Ballard . | |
| 3,605,355 | 9/1971 | Solesbee . | |
| 3,638,373 | 2/1972 | Chapman . | |
| 3,699,731 | 10/1972 | Arnold . | |
| 3,701,225 | 10/1972 | Perry . | |
| 3,727,354 | 4/1973 | Powell . | |
| 3,736,708 | 6/1973 | Chapman . | |
| 3,823,522 | 7/1974 | Jureit et al. . | |
| 4,073,099 | 2/1977 | Van der Lely et al. | 52/92.1 |
| 4,167,090 | 9/1979 | Sanford . | |
| 4,686,802 | 8/1987 | O'Driscoll | 52/94 |
| 4,831,807 | 5/1989 | Bolt . | |
| 4,850,174 | 7/1989 | Valente . | |
| 5,094,059 | 3/1992 | Ganescu . | |

FOREIGN PATENT DOCUMENTS 4-319151 11/1992 Japan ..... 52/94

*Primary Examiner*—Carl D. Friedman
*Assistant Examiner*—Kien Nguyen
*Attorney, Agent, or Firm*—Foley & Lardner

[57] ABSTRACT

A prefabricated building structure includes a hip roof that is collapsible so that the building structure may be transported from a manufacturing site to an assembly site, such as a homesite, in compliance with governmental regulations related to height and width restrictions on public highways. The building structure with the hip roof offers an alternative to the conventional gabled roof used in prefabricated houses and other buildings. The prefabricated building structure includes modular units secured together to provide an integral building structure, at least two of the modular units each including a collapsible, complementary hip roof system. Each hip roof system includes a plurality of transversely disposed, longitudinally spaced trusses including front trusses and front hip trusses; a plurality of longitudinally disposed, transversely spaced gable trusses, the gable trusses being substantially perpendicular to the front hip trusses; and a connector for connecting the front hip trusses to the gable trusses. Selected ones of the front, front hip, and gable trusses and the connector are hinged for folding to reduce overall dimensions of the hip roof system. Also provided is a method for erecting the hip roof system at the home site and a method of making the hip roof system.

22 Claims, 5 Drawing Sheets

PREFABRICATED BUILDING STRUCTURE HAVING A COLLAPSIBLE HIP ROOF AND METHOD OF ERECTING THE ROOF

BACKGROUND OF THE INVENTION

The present invention relates in general to a prefabricated building structure and in particular to a prefabricated building structure having a collapsible hip roof.

In the building construction industry, a technique has been developed and extensively used for constructing prefabricated building structures. The technique consists of fabricating modular building units at a manufacturing site, hauling such units on vehicles to remote sites, transferring the units from the hauling vehicles onto a foundation at the home site, securing the units together on the foundation to form an integral building structure, and then connecting the electrical, water and sewage lines of the structure to appropriate utility lines. The use of such a technique has enabled the use of mass production methods in the fabrication of building structures, thus providing increased economy, improved product quality, and reduced construction time.

Because prefabricated modular units must be transported over public highways from a manufacturing site to a remote erection site, one of the principal limiting factors in the design of building structures constructed of modular units has been the restrictions on the size of modular units transported over public highways imposed by municipal, county and state governments, or dictated by highway conditions such as road and tunnel widths, clearance heights of underpasses, and the like. Generally, municipal, county and state governments have adopted various vehicle ordinances restricting the height, length and width of any unit transported over public highways.

U.S. Pat. No. 3,727,354 to Powell, which is herein incorporated by reference, discloses a prefabricated building structure consisting of two or more modular units, which is provided with a roof having a standard roof pitch and in which the heights and widths of the modular units fall within the permissible dimensional limitations with respect to hauling the units over public highways. Conventional prefabricated modular units for residential building structures, such as disclosed in Powell, have been limited to structures with gable roofs. Because only gable roof structures are available, a buyer of prefabricated residential housing is necessarily limited in his or her choice of roof design. Furthermore, when an entire subdivision is comprised of prefabricated homes having gable roofs, the homes tend to be indistinguishable because of the lack of variety.

The present invention provides a prefabricated building structure having a hip roof which is collapsible so that the modular units may be safely and legally transported over public highways. The provision of a collapsible hip roof design allows prefabricated home buyers a greater selection in home design. In addition, subdivisions comprised of prefabricated homes may include both gable roof and hip roof designs, thereby improving the appearance of the subdivision. The present invention also includes a method for erecting the collapsible hip roof at the home site and a method for making the hip roof system.

SUMMARY OF THE INVENTION

It is an object of the present invention to provide a prefabricated building structure having a collapsible hip roof so that home buyers will have a wider range of house designs from which to choose.

It is another object of the invention to provide a prefabricated building structure having a collapsible hip roof so that subdivisions comprised of prefabricated housing will have more diverse designs, thereby improving the overall appearance of the subdivision.

It is a further object of the invention to provide a prefabricated building structure having a collapsible hip roof which is safely and legally transportable over public highways.

It is a still further object of the present invention to provide a prefabricated building structure having a collapsible hip roof that requires a minimum of labor to assemble at the homesite.

It is yet a further object of the invention to provide a method for erecting the collapsible hip roof at the home site, wherein the method requires a minimum of time and expense.

It is another object of the invention to provide a method of making the collapsible hip roof at a manufacturing site.

One aspect of the present invention is a prefabricated building structure including modular units secured together to provide an integral building structure, at least two of the modular units each having a collapsible, complementary hip roof system. Each collapsible, complementary hip roof system includes a plurality of transversely disposed, longitudinally spaced trusses including front trusses and front hip trusses; a plurality of longitudinally disposed, transversely spaced gable trusses, the gable trusses being substantially perpendicular to the front hip trusses; and a connector for connecting the front hip trusses to the gable trusses; wherein selected ones of the front, front hip, and gable trusses and the connector are hinged for folding to reduce overall dimensions of the hip roof system.

Another aspect of the present invention is a method for erecting a collapsible hip roof of a modular unit of a prefabricated building structure from a collapsed position to an operative position including the steps of raising a center section of the roof from a collapsed position to an operative position; installing a support structure for supporting upper, inner ends of front trusses of the roof; raising gable sections of the roof from collapsed positions to operative positions; connecting front hip trusses to gable trusses; repeating the above four steps for a collapsible hip roof for a second modular unit; and connecting the two operatively positioned hip roofs together to form a unitary hip roof for the prefabricated building structure.

The aforementioned objects and advantages and other objects and advantages of the present invention will be apparent from the following detailed description of the preferred embodiments, taken in conjunction with the attached drawings.

BRIEF DESCRIPTION OF THE DRAWINGS

The drawings are hereby expressly made a part of the specification, in which.

DETAILED DESCRIPTION OF THE PREFERRED EMBODIMENTS

The present invention relates to a prefabricated building structure having a hip roof that is collapsible so that the building structure may be transported from the manufacturing site to the home site in compliance with governmental regulations related to height and width restrictions on public highways. The building structure with the hip roof offers an alternative to the conventional gabled roof used in prefabricated houses. The prefabricated building structure includes modular units secured together to provide an integral building structure. Modular units which have roof portions each include a collapsible, complementary hip roof system. The present invention is also directed to a method for erecting a collapsible hip roof from a collapsed position to an operative position.

Figure 1:
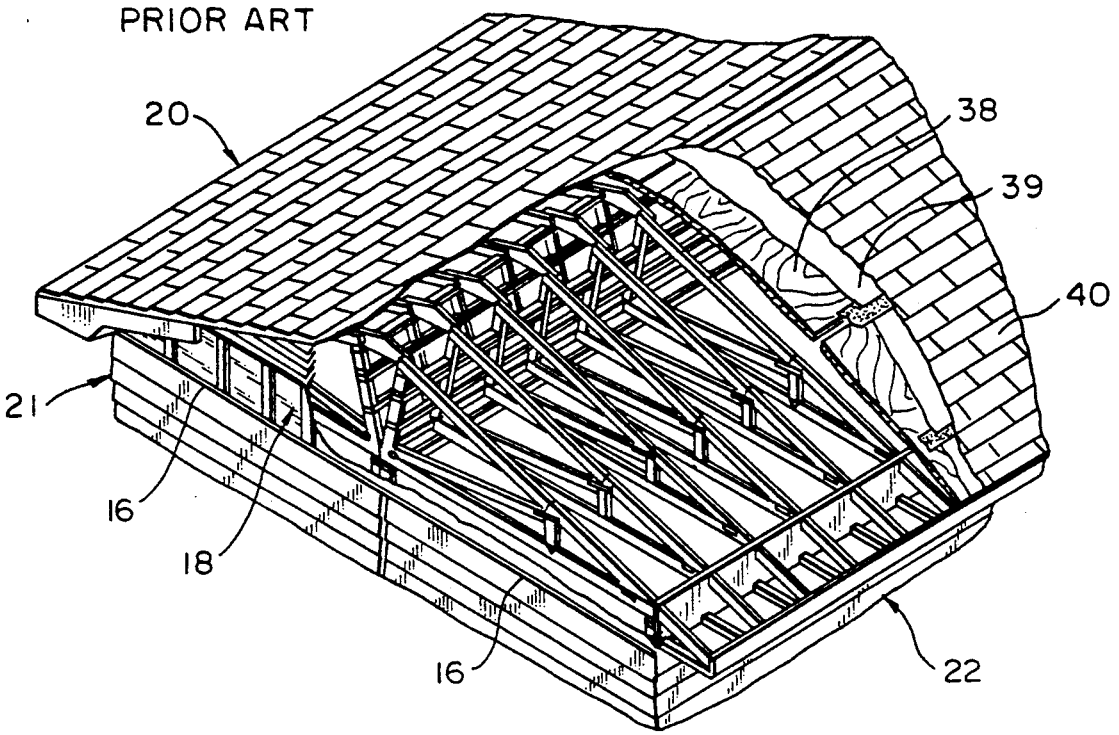
FIG. 1 PRIOR ART
FIG. 1 is a cutaway fragmentary perspective view of a prior art prefabricated building having a collapsible gable roof wherein the roof is in its operative position.

FIG. 1 shows a prior art prefabricated building structure 20 which includes two substantially similar modular units 21, 22. Each modular unit 21, 22 includes a housing assembly 23, 23*a*; exterior walls 24, 24*a*; interior junction walls 25, 25*a*; and component roof systems 26, 26*a*. Each component roof system 26, 26*a* includes a stationary roof section 27, 27*a*; a moveable roof section 28, 28*a*; and an overhang roof section 29, 29*a*.

As best seen in FIG. 1, the framing of the roof sections is covered by, for example, plywood sheathing 38, felt or a similar material 39, and shingles 40.

Figure 2:
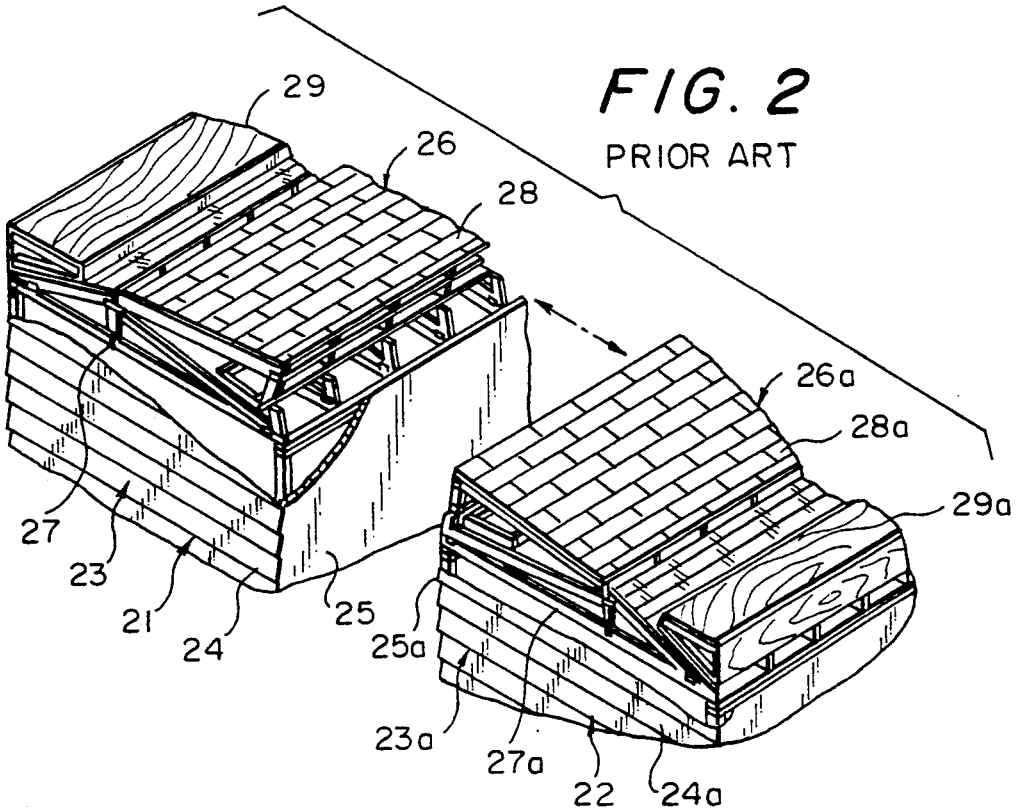
FIG. 2 PRIOR ART
FIG. 2 shows the constituent modular units of the prior art building of FIG. 1 wherein the gable roof is in its collapsed position.

The prior art prefabricated building structure shown in FIGS. 1 and 2 results in a finished structure having a gable 18, as shown in FIG. 1. The gable 18 is the triangular wall section at the end of the roof, bounded by the two roof slopes and the line 16.

Figure 3:
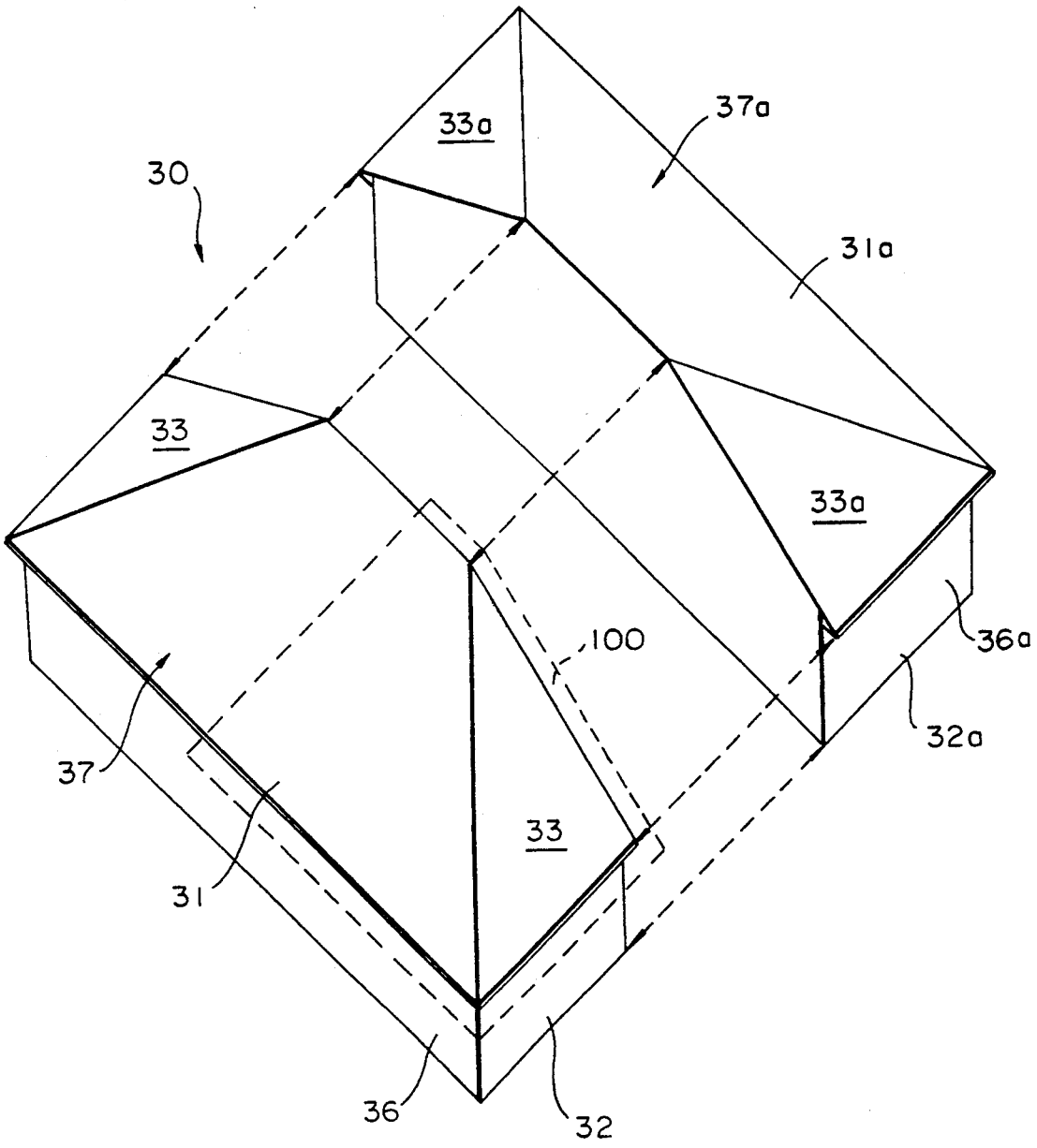
FIG. 3 shows a schematic view of the constituent modular units of a prefabricated building structure having the collapsible hip roof of the present invention wherein the hip roof is in its operative position.

FIG. 3 schematically shows a prefabricated building structure 30 built in accordance with the present invention. Rather than a gable roof design, the finished structure exhibits a hip roof design. The structure of FIG. 3 includes two substantially similar modular units 32, 32*a*. The substantially similar modular units 32, 32*a* include exterior walls 36, 36*a* and complementary, collapsible hip roof systems 37, 37*a*. In contrast to the gable roof of the prior art, the collapsible hip roof of the present invention includes center sections 31, 31*a* and gable sections 33, 33*a*. The sloping gable sections 33, 33*a* replace the gable ends of the prior art roof.

It is also possible for the prefabricated building structure of the present invention to include four modular units. Such a structure would be of the two-story type, wherein two of the modular units would comprise the first story and would not include a roof system, and wherein the other two modular units would comprise the second story and would include the hip roof system of the present invention.

Figure 4:
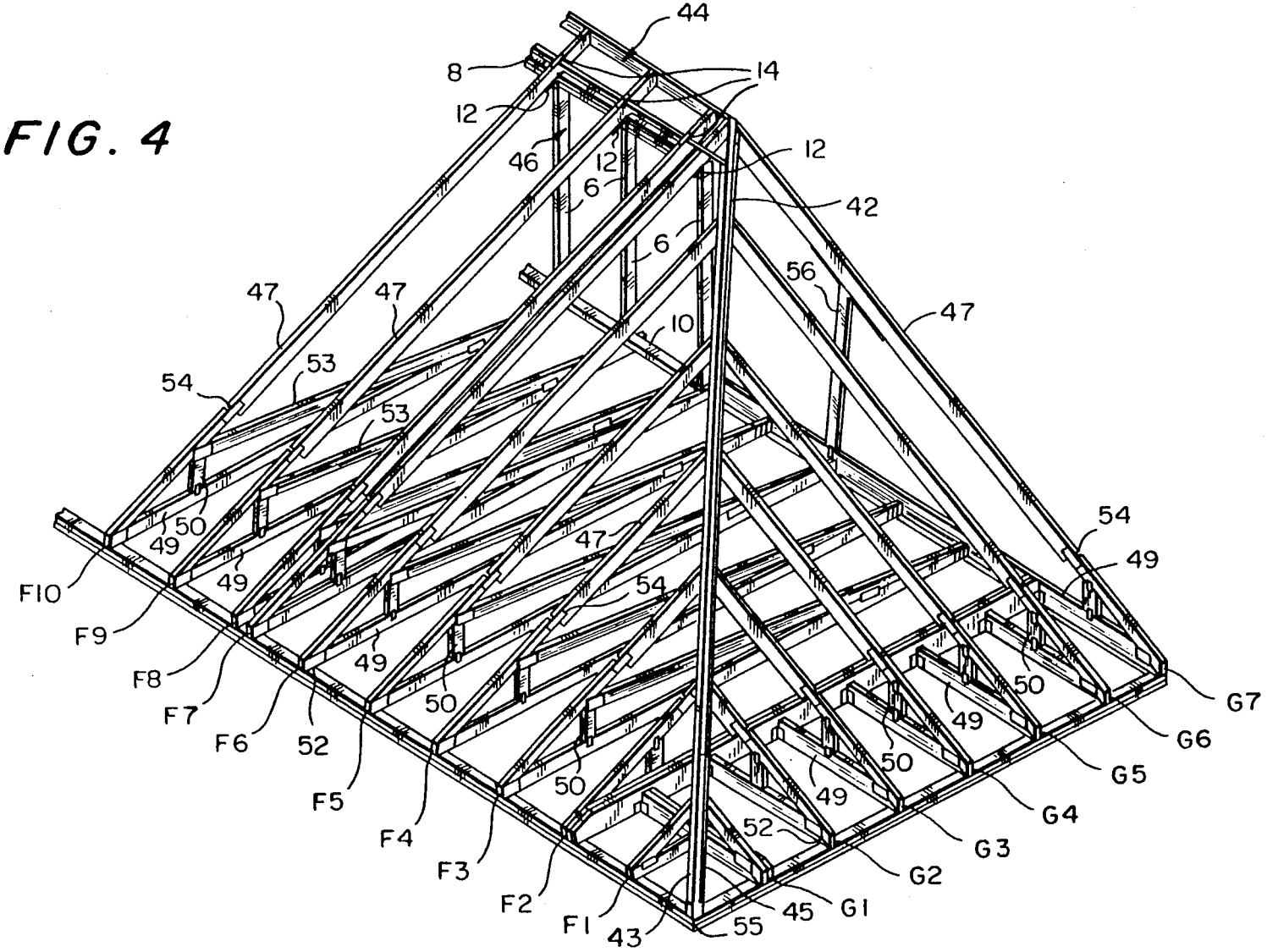
FIG. 4 is a fragmentary perspective view of the collapsible hip roof of one modular unit, with the means for covering the roof removed.

FIG. 4 shows the framing for the portion 100 of the hip roof shown within the dashed lines in FIG. 3, wherein the means for covering the roof is removed for the sake of clarity. The means for covering the roof includes plywood sheathing, a layer of felt or a similar material and shingles. While FIG. 4 shows one corner of one modular unit having a complementary hip roof system, it is noted that at least two modular units will each have a complementary hip roof system. In addition, although FIG. 4 shows one corner of a complementary hip roof system, the opposite corner of the modular unit is constructed substantially the same.

The hip roof of the present invention includes a plurality of transversely disposed, longitudinally spaced trusses including front trusses and front hip trusses. In the embodiment shown in FIG. 4, the front hip trusses are labelled F1–F7 and the front trusses are labelled F8–F10. Arranged in planes perpendicular to the planes of the front and front hip trusses are a plurality of longitudinally disposed, transversely spaced gable trusses, labelled G1–G7 in the embodiment shown in FIG. 4. The gable trusses G1–G7 are connected to the front hip trusses F1–F7 by a connector 42. Selected ones of the front, front hip, and gable trusses and the connector are hinged for folding to reduce overall dimensions of the hip roof system. In FIG. 4, front trusses F8–F10, front hip trusses F2–F7, gable trusses G2–G7, and connector 42 are hinged for folding.

It is noted that the number of front, front hip and gable trusses shown in FIG. 4 is merely exemplary. A greater or lesser number of these trusses may be used, depending on the desired width and length of the building. In particular, only three front trusses F8–F10 are shown in FIG. 4. However, the hip roof system actually includes additional front trusses to the left of truss F10 in FIG. 4. The exact number of additional front trusses depends on the desired length of the building. The last front truss to the left of truss F10 is then followed by a series of front hip trusses and gable trusses. That is, the corner structure of the roof to the left of truss F10 in FIG. 4 is substantially the same as the corner structure shown in FIG. 4. In the following description, when reference is made to front trusses F8–F10, front hip trusses F1–F7, or gable trusses G1–G7, it is to be understood that such reference includes variable numbers of the respective truss types.

Figure 5:
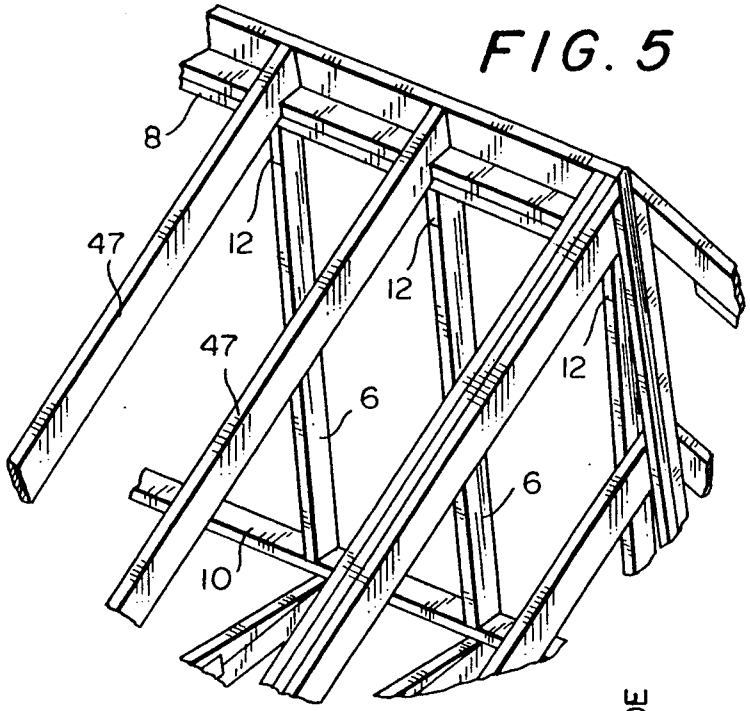
FIG. 5 is a detail of the upper, inner ends of the trusses of FIG. 4 showing the hip roof without an extension panel.

To further reduce the overall dimensions of the collapsed roof, an extension panel 44 may be rotatably connected to upper, inner ends of the front trusses F8–F10. The extension panel 44 is hinged by hinge plates 14 to each of the front trusses F8–F10 for counterclockwise rotation about 180° from the position shown in FIG. 4, so that the roof covering material (not shown) on the extension panel 44 contacts the roof covering material (not shown) on the front trusses F8–F10. Therefore, a smaller overall dimension of the hip roof system is accomplished with the extension panel 44 folded back 180°. The extension panel 44 is desirable when a smaller overall dimension is required, as when transporting the modular units through a jurisdiction having stricter length and width regulations. FIG. 5 shows the upper ends of the top chords 47 without the extension panel 44.

A support structure 46 provides support to the hinged top chords 47 of the front trusses F8–F10. The support structure 46 is preferably rotatably connected by hinge plates 12 to upper, inner ends of the hinged chords 47 of the front trusses. The support structure 46 includes two longitudinally disposed beams 8, 10 interconnected by vertical members 6. The longitudinal extent of the support structure 46 corresponds to the variable longitudinal extent of the front trusses F8–F10, which variable extent continues to the left of the truss F10 in FIG. 4.

Figure 7:
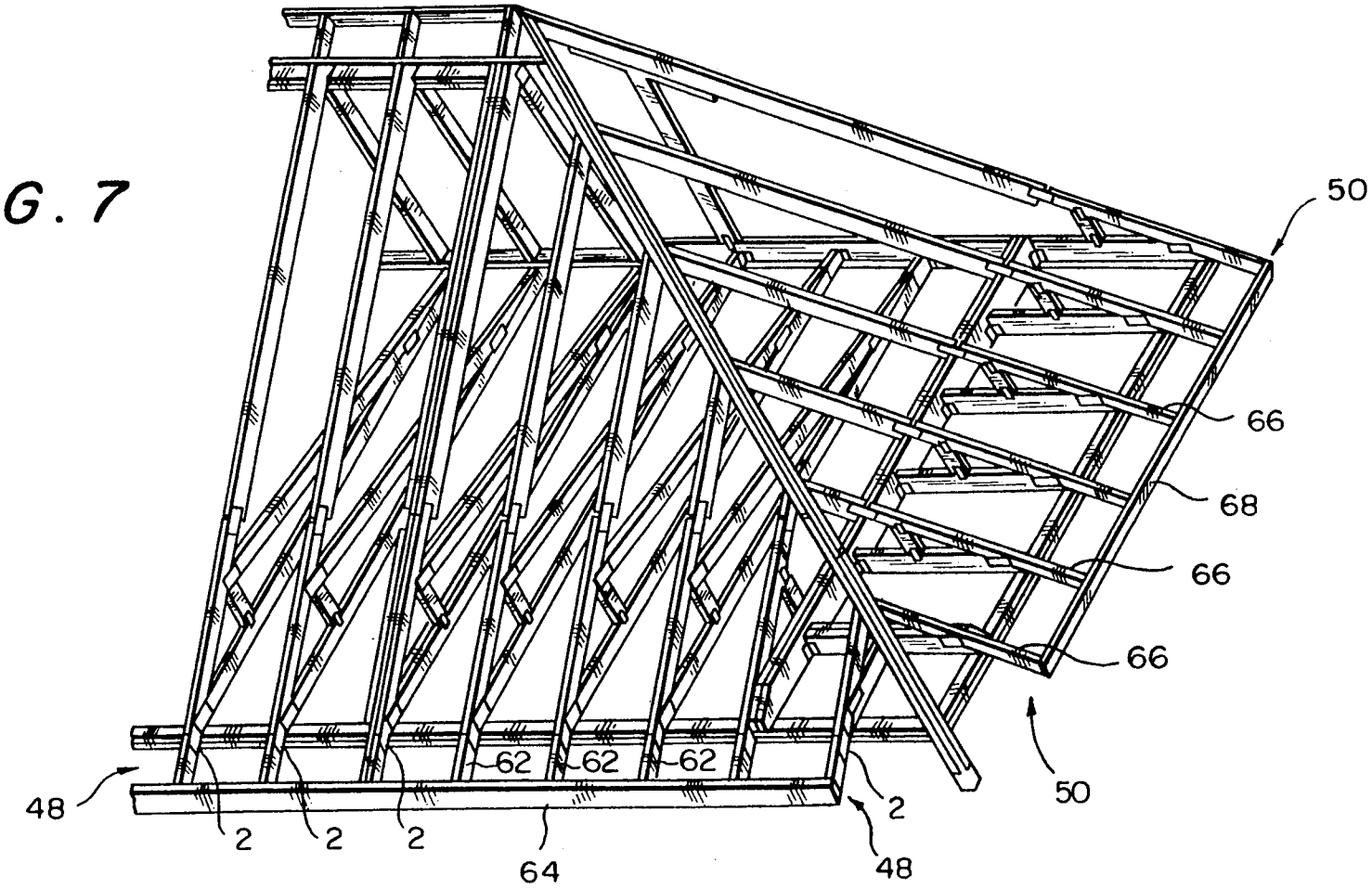
FIG. 7 shows front and gable overhangs.

As shown in FIG. 7, the front and front hip trusses may include a front overhang 48. The front overhang 48 is rotatably connected by hinges 2 to the front and front hip trusses. Because the front overhang 48 is rotatably connected to the front and front hip trusses, it may be rotated backwards about 180° so that the roof covering material (not shown) on the overhang 48 contacts the roof covering material (not shown) on the front and front hip trusses. With a hinged front overhang 48, the overall dimensions of the roof can be decreased for transport. Similarly, a gable overhang 50 may be provided for the gable trusses. The gable overhang 50 is integrally formed with the gable trusses. Alternatively, both the gable and front overhangs could be hinged, both fixed, or one fixed and one hinged, as desired. The front overhang 48 includes a plurality of transversely disposed, longitudinally spaced members 62 connected to a longitudinal beam 64. The gable overhang includes a plurality of longitudinally disposed, transversely spaced members 66 connected to a transverse beam 68. Both front and gable overhangs include the same roof covering material (not shown) as the trusses.

Referring to the embodiment shown in FIG. 4, each of the front, front hip, and gable trusses, except the F1 and G1 trusses, includes a hinged top chord 47, a bottom chord 49, and a web member 50 connected between the hinged top chord 47 and the bottom chord 49. Hinge plates 54 on the hinged top chords 47 allow the top chords to be rotated down into a collapsed position. The bottom chords 49 and hinged top chords 47 of the trusses meet at a heel end 52 of each truss. The trusses may also be provided with diagonal chords 53 connected between the inner ends of the bottom chords 49 and the intersection of the top chords 47 with the web members 50.

Figure 6:
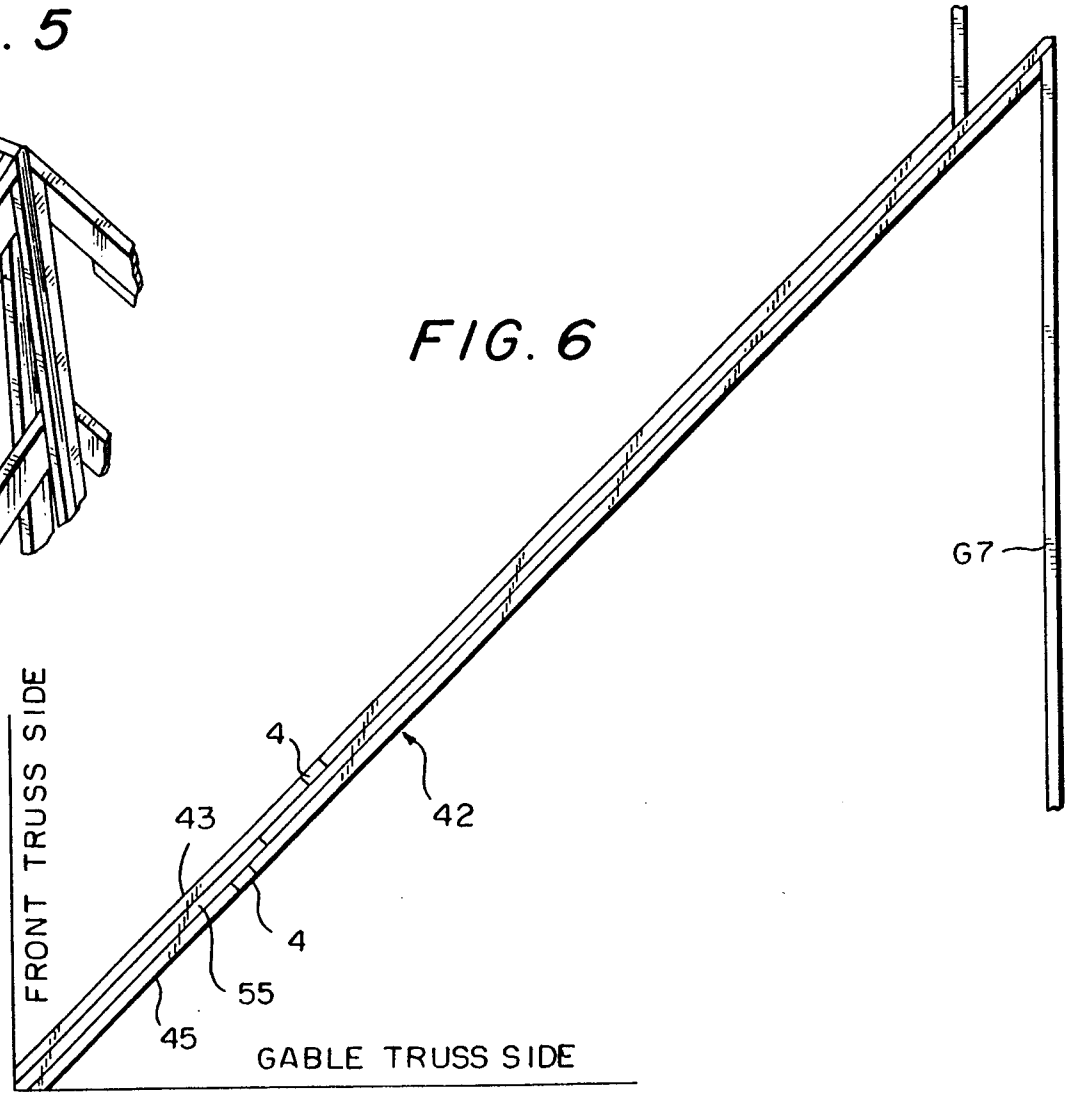
FIG. 6 is a top view of the connector 42 shown in FIG. 4.

As shown in FIGS. 4 and 6, the connector 42 includes a first hinged member 43, a second hinged member 45 and a central member 55. The first hinged member 43 is connected to the front hip trusses F1–F7 and the second hinged member 45 is connected to the gable trusses G1–G7. The members 43 and 45 are also provided with hinge plates 4 for folding forward, as shown in FIG. 6.

To prepare the modular units including the collapsible hip roof system for transportation, the support structure 46 is rotated clockwise from its position in FIG. 4, so that it is in a plane substantially parallel to the plane of the hinged top chords 47. A hinged support post 56 for gable truss G7 is hingedly connected to the bottom chord 49 of gable truss G7 so that it folds forward into a position substantially parallel with the bottom chords 49 of the front and front hip trusses. The center section of the roof, which includes the front and front hip trusses and the first hinged member 43 of the connector 42, is folded down until it meets the bottom chords 49. Likewise, the gable section of the roof and the hinged gable trusses including the second hinged member 45 of the connector 42 are folded down. If an extension panel 44 is included, the extension panel is rotated back about 180° to rest on the roof covering of the front trusses. If a hinged overhang is provided, the hinged overhang is likewise folded back about 180° to rest on the roof covering the trusses. In this collapsed position, the overall dimensions of the collapsible hip roof are decreased so that the modular unit including the hip roof may be transported from the manufacturing site to the home site.

Upon arrival at the home site, the modular units are arranged side by side. The hip roof must then be raised from a collapsed position to an operative position. The various sections of the roof are raised by a crane, jack, or a similar machine.

First, the center section of the roof, including the front and front hip trusses and the connector member 43, is raised so that the upper and lower parts of the hinged top chords 47 form a straight line. A support structure 46 for supporting the upper, inner ends of the front trusses of the roof is installed. Preferably, the support structure 46 is rotatably attached to the upper, inner ends of the front trusses so that installation of the support structure involves merely rotatably unfolding the support structure into position against the bottom chords 49. It is noted that the first hinged member 43 of the connector 42 is raised into position along with the center section of the roof.

Next, each gable section of the roof, including the gable trusses and the connector member 45, is raised to an operative position. The hinged support post 56 is folded upward into position below the gable truss G7 to help support the gable section of the roof. It is noted that the second hinged member 45, because it is attached to the upper ends of the gable trusses, is raised simultaneously with the gable section of the roof. The connector 42 is completed by installing a board into the gap between the first and second hinged members, 43 and 45. If an extension panel 44 is included with the roof, the extension panel is unfolded so that the panel is in the same plane as the hinged top chords 47. Likewise, if a hinged front or gable overhang is present, the overhang is unfolded so that the overhang is in the same plane as the top chord members of the trusses.

The same procedure is followed for the hip roof system atop the second modular unit. After the hip roof systems on both modular units are raised, the alignment of all ridge points and overhangs is checked and confirmed. Then, the first hinged member 43, second hinged member 45 and central member 55 on each end of both hip roof systems are bolted or nailed together. Next, the two separate hip roof systems are connected together to form a unitary complete hip roof. The hip trusses G7 are bolted or nailed together on either side of the modular units. Additionally, the center ridge beams are bolted or nailed together. Then, any other finishing that may be needed to be done to the roof material is accomplished.

Although the present invention has been described with reference to certain preferred embodiments, it should be understood that the described embodiments are merely illustrative and not intended to be all inclusive. Many variations and alternatives to the preferred embodiments are possible, and are intended to be part of the invention, as recited in the appended claims and equivalents thereof.

What is claimed is:

1. A prefabricated building structure comprising at least two modular units secured together to provide an integral building structure, at least two of said modular units each including a collapsible, complementary hip roof system comprising:

a plurality of transversely disposed, longitudinally spaced trusses including front trusses and front hip trusses;

a plurality of longitudinally disposed, transversely spaced gable trusses, said gable trusses being substantially perpendicular to said front hip trusses; and a connector for connecting said front hip trusses to said gable trusses;

wherein selected ones of said front, front hip, and ( gable trusses and said connector are hinged for folding to reduce overall dimensions of said hip roof system.

2. The building structure of claim 1, further comprising an extension panel rotatably connected to upper, inner ends of said front trusses.

3. The building structure of claim 1, further comprising a support structure for supporting upper, inner ends of said front trusses, wherein said support structure is rotatably connected to said upper, inner ends.

4. The building structure of claim 1, wherein said front trusses and said front hip trusses further comprise a front overhang.

5. The building structure of claim 4, wherein said front overhang is rotatable.

6. The building structure of claim 1, wherein said gable trusses further comprise a gable overhang.

7. The building structure of claim 5, wherein said gable overhand is rotatable.

8. The building structure of claim 1, wherein said connector comprises a first hinged member connected to upper, inner ends of said front hip trusses and a second hinged member connected to upper, inner ends of said gable trusses.

9. The building structure of claim 1, wherein said selected ones of said front, front hip, and gable trusses each comprise a hinged top chord, a bottom chord, and a web member connected between said top and bottom chords and wherein said top and bottom chords intersect at heel ends of said trusses.

10. The building structure of claim 1, further comprising means for covering said hip roof system.

11. The building structure of claim 10, wherein said means for covering includes sheathing applied to said trusses and roofing material applied to said sheathing.

12. In a prefabricated building structure having modular units secured together to provide an integral building structure, a collapsible, complementary hip roof for each of at least two of said modular units, said hip roof comprising:

a plurality of transversely disposed, longitudinally spaced trusses including front trusses and front hip trusses;

a plurality of longitudinally disposed, transversely spaced gable trusses, said gable trusses being substantially perpendicular to said front hip trusses; and a connector for connecting said front hip trusses to said gable trusses;

wherein selected ones of said front, front hip, and gable trusses and said connector are hinged for folding to reduce overall dimensions of said hip roof.

13. The hip roof of claim 12, further comprising an extension panel rotatably connected to upper, inner ends of said front trusses.

14. The hip roof of claim 12, further comprising a support structure for supporting upper, inner ends of said front trusses wherein said support structure is rotatable connected to said upper, inner ends.

15. The hip roof of claim 12, wherein said front and said front hip trusses further comprise a front overhand.

16. The hip roof of claim 15, wherein said front overhang is rotatable.

17. The hip roof of claim 12, wherein said gable trusses further comprise a gable overhang.

18. The hip roof of claim 16, wherein said gable overhang is rotatable.

19. The hip roof of claim 12, wherein said connector comprises a first hinged member connected to upper, inner ends of said front hip trusses and a second hinged member connected to upper, inner ends of said gable trusses.

20. The hip roof of claim 12, wherein said selected ones of said front, front hip, and gable trusses each comprise a hinged top chord, a bottom chord, and a web member connected between said top and bottom chords and wherein said top and bottom chords intersect at heel ends of said trusses.

21. The hip roof of claim 12, further comprising means for covering said hip roof system.

22. The hip roof of claim 21, wherein said means for covering includes sheathing applied to said trusses and roofing material applied to said sheathing.

* * * * *